United States Patent [19]

Montgomery

[11] 3,951,290

[45] Apr. 20, 1976

[54] CHILD-RESISTANT OVERCAP FOR A SCREW-TYPE CONTAINER CAP

[75] Inventor: Gary Van Montgomery, Evansville, Ind.

[73] Assignee: Sunbeam Plastics Corporation, Evansville, Ind.

[22] Filed: June 6, 1975

[21] Appl. No.: 584,576

[52] U.S. Cl. ..... 215/219

[51] Int. Cl.[2] ..... B65D 55/02; B65D 85/56; B61J 1/00

[58] Field of Search ..... 215/9, 219, 220

[56] References Cited

UNITED STATES PATENTS

| | | | |
|---|---|---|---|
| 3,027,035 | 3/1962 | Farago | 215/219 |
| 3,892,325 | 7/1975 | Maguire | 215/219 |

*Primary Examiner*—George T. Hall

*Attorney, Agent, or Firm*—Henry K. Leonard

[57] ABSTRACT

A child-resistant overcap adapted to be positioned over a threaded screw cap which has axially extending ribs on the outer surface of its threaded skirt, in order to make the entire closure child-resistant. The overcap has a disc-like top and a cylindrical skirt which nests over the screw cap. An inwardly extending lip on the bottom edge of the overcap skirt retains the overcap in position after assembly. The disc-like top of the overcap is slotted with at least two diametric slots, arranged with their axes normal to each other. One slot is formed by two diametrically opposed, outwardly converging pairs of edges defining V-notches and the other slot may be a narrow slit. The inner wall of the overcap skirt has at least one axial driving rib which protrudes radially inwardly and is located at the outer end of the narrow slit. Squeezing the overcap radially inwardly along the diameter of the narrow slit flexes the top and moves the driving rib or ribs into engagement with the skirt of the threaded inner cap for delivering torque thereto.

4 Claims, 3 Drawing Figures

CHILD-RESISTANT OVERCAP FOR A SCREW-TYPE CONTAINER CAP

BACKGROUND OF THE INVENTION

Many so-called child-proof or, more properly, child-resistant closures have been proposed for use on various types on containers in which medicines, household chemicals and the like are sold in retail markets. Most of those previously suggested closures have comprised either a one-piece cap which cooperates with a specially configured bottle neck finish or a two-piece cap consisting of two nested inverted cup shaped elements, both of which are special and both of which have parts especially designed for cooperation with each other.

The purpose of all of these child-resistant closures is to make it significantly difficult for a small child, say, up to the age of six, or so, to gain access to the material in the container while yet making it possible for an older child or an adult who can comprehend the necessary manipulations to open the particular container.

Most of these previously suggested child-resistant closures are quite expensive to manufacture, requiring more material, more complex and expensive molds and, sometimes, difficult assembly problems, which increase the costs of their manufacture.

Very few of the previously suggested child-resistant closures make use of what is well known in the trade as a "standard" threaded metal screw cap. Such a "standard" threaded metal screw cap almost always has a circumferentially extending series of ribs or serrations formed in the upper edge of its threaded skirt at what might be called the "shoulder" of the cap i.e., where the skirt joins the flat top. These ribs or serrations are provided in order to enable one who wishes to turn the cap to hold it tightly i.e., they are friction creating elements.

It is the principal object of the instant invention to provide a child-resistant overcap which is specifically designed so that it is adapted to be merely snapped over a standard metal screw cap of the type described above and, after being snapped in place, renders the two-part closure effectively child-resistant.

It is another, more specific object of the instant invention to provide a child-resistant overcap for use with a standard threaded metal screw cap which readily can be varied to increase or decrease the degree of resistance to its actuation, depending upon the serious nature of the material in the container and the degree of child-resistance which it is desired to provide.

It is yet a further object of the instant invention to provide a single-piece, child-resistant overcap which, in itself, is not a closure for a bottle or other container having a threaded neck but which quickly and readily can be snapped into place over a standard metal screw cap regardless of the material from which the bottle itself is fabricated and without requiring any special cooperating elements on the bottle or its neck and without requiring any special design of the metal screw cap itself.

While the over-cap of the invention will be illustrated as applied to a metal screw cap, it is also contemplated that the over-cap readily can be used with screw caps fabricated from hard plastic materials, the only requirement being the presence thereon of the vertical ribs or serrations similar to those normally present on metal screw caps.

DESCRIPTION OF PREFERRED EMBODIMENT

Figure 1:
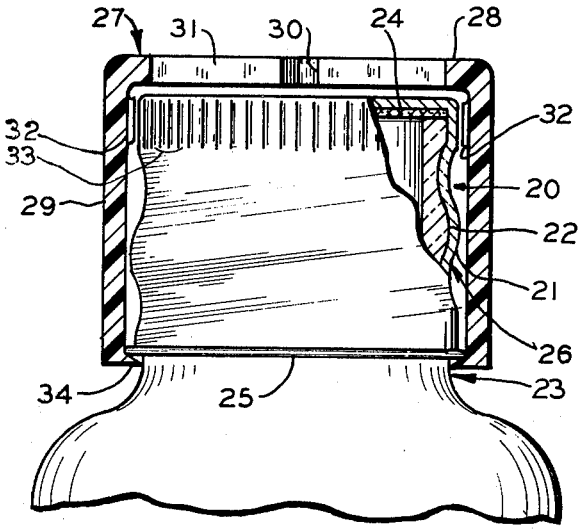
FIG. 1 is a fragmentary, diametric, vertical sectional view of an overcap embodying the invention in place in nesting relation on a standard threaded metal screw cap of the type described above, the overcap being shown in inoperative position.

A standard threaded metal screw cap is generally indicated by the reference number 20 and usually has rolled threads 21 which mate with threads 22 on a container neck 23. A cap 20 of this type usually also has an interior liner 24 which is squeezed against the edge of the neck 23 when the cap 20 is tightly threaded onto the bottle. A cap 20 also usually has a rolled rim 25 at the bottom edge of its threaded skirt 26, with the rim being provided, primarily, to eliminate a sharp metal edge.

Metal screw caps of the type described are well known in the art, are very expensive to manufacture and can be used on glass, plastic and metal containers. Metal caps of this type have at least one advantage over plastic caps used for the same purpose in that they can withstand products which adversely affect plastic caps.

Although not shown in the drawings, caps for threaded container necks sometimes have skirts connected by frangible annular portions which first must be broken before the caps can be removed. Caps of this type are frequently placed on soft drink bottles, liquor bottles and the like so that the bottles can be resealed after initially being opened. After the frangible connection has been broken, however, the cap is quite similar to the cap 20 and functions in the same way.

An overcap embodying the invention is generally indicated by the reference number 27. Such a cap 27 has a disc-like top 28 and a cylindrical skirt 29 so that it nests over the screw cap 20. The interior diameter of the skirt 29 is greater than the maximum exterior diameter of the cap 20 and its skirt 29 has an axial length slightly greater than the axial length of the cap 20.

Figure 2:
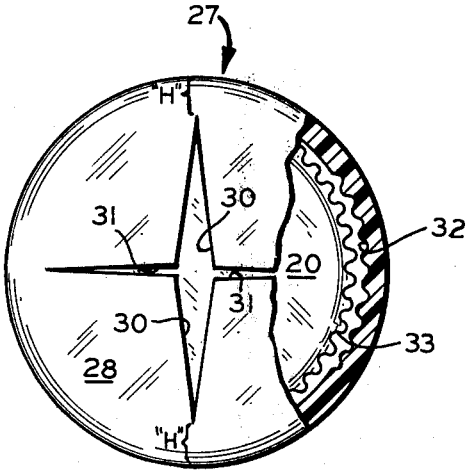
FIG. 2 is a top plan view, with parts broken away, of the overcap shown in FIG. 1 and illustrated in inoperative position, in which position rotation of the overcap does not deliver torque to the interior standard threaded cap and the container cannot be opened.

In the embodiment of the invention illustrated in the drawings, the disc-like top 28 has two diametric pairs of slots or openings which are arranged with their axes normal to each other. One slot consists of two diametrically opposed, outwardly converging pairs of edges defining V-notches 30. A diametric line bisecting the two notches 30 extends substantially across the cap top 28 through its center point and is normal to a second diametric line which defines the center of two aligned narrow slits 31 also formed in the cap 28. The slits 31 are illustrated in FIG. 2 as being narrow V-shaped but, actually, should preferably be merely knife cuts or other narrow slits. It will be observed in FIG. 1 that both sets of notches 30 and 31 are cut through the material forming the top 28 but that neither of the sets of notches 30 or 31 is cut outwardly to the full limit of the top 28. This leaves short portions of the material of the top 28, generally indicated by the brackets "H", and shown in FIGS. 2 and 3, to act as "hinges" during the manipulation of the overcap 27 as further will be described below.

In the embodiment of the invention illustrated in the drawings, the overcap 27 has two circumferentially extending sets of driving ribs 32 formed on the inner-surface of its skirt 29 which protrude radially inwardly and are located, respectively, in alignment with the ends of the slits 31. The driving ribs 32 are circumferentially spaced and shaped to be substantially complementary to a series of friction ribs 33 which extend entirely around the shoulder of the screw cap 20. In the normal undistorted condition of the overcap 27, the inside diameter between the inner edges of the driving ribs 32 is greater than the outside diameter of the friction ribs 33 on the screw cap 20. Thus, in the condition illustrated in FIGS. 1 and 2, if one rotates the overcap 27 no torque is delivered to the inner bottle cap 20 and a small child is unable to gain access to the contents of the bottle thus closed.

The overcap 27 also has an inwardly directed lip 34 at the bottom edge of its skirt 29 which snaps in beneath the rim 25 on the screw cap 20 in order to nest the overcap 27 on the bottle cap 20 and retain the overcap 27 in place after it is so positioned.

Figure 3:
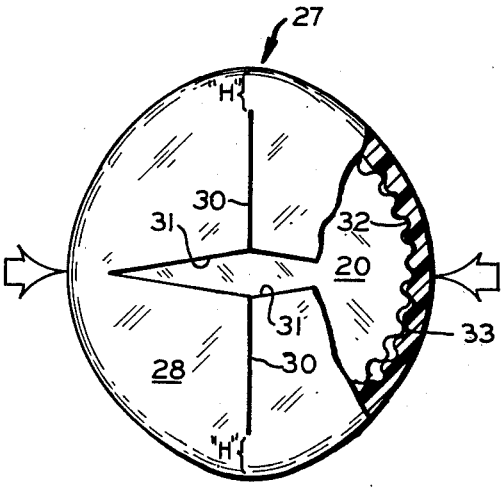
FIG. 3 is a view similar to FIG. 2 but showing how an overcap embodying the invention is actuated to place it in operative position at which time torque delivered to the overcap is transferred to the inner screw cap and the entire closure can be removed from the container by an older child or an adult.

When an older child or an adult seeks to gain access to the contents of the container having a closure comprising an overcap according to the invention, he squeezes the overcap in the direction indicated by the arrows in FIG. 3 which flexes the two sets of hinges "H", closing the normally open V-notches 30 and opening the normally closed slits 31 as shown in FIG. 3. This enables the driving ribs 32 to be moved into an engagement with the friction ribs 33 so that when torque is applied to the overcap 27, that torque is delivered to the inner screw cap 20. By molding the overcap 27 from a relatively stiff resinous material which will not quickly wear away, such as, for example, high-impact polypropylene and by determining the outward radial extent of the two sets of openings i.e., the V-notches 30 and the slits 31 to the hinges "H" of desired size, the force necessary to squeeze the overcap 27 inwardly as illustrated in FIG. 3 can be positively determined.

Upon release of the pressure exerted inwardly to engage the driving ribs 32 with the friction ribs 33, the resiliency of the overcap 27 causes it to restore to circular shape, as shown in FIG. 2, once again disengaging the cooperating sets of driving ribs 32 and friction ribs 33 so that the closure is once again child-resistant.

Having described my invention I claim:

1. A child-resistant overcap for a threaded screw cap having a flat top, an annular threaded skirt mating with the threads on a bottle neck and a plurality of axially-extending ribs on the outer surface of the skirt, said overcap comprising, a. a generally disc-like top, b. an open bottom, annular skirt depending from said top and having an inside diameter larger than the outside diameter of said ribs on said screw cap and adapted to be nested over said screw cap and freely rotatable relative thereto when said overcap is not distorted, c. a pair of diametrically opposed, outwardly converging V-notches in the top of said overcap, d. a pair of diametrically aligned narrow slits in the top of said overcap, said slits being normal to the diameter bisecting said V-notches, and e. at least one radially inwardly protruding, axially-extending driving rib on the inner wall of said skirt of said overcap that is radially aligned with said ribs on said screw cap and not engageable therewith when said overcap is not distorted, said driving rib being positioned at the outer end of at least one of said narrow slits.

2. An overcap according to claim 1 in which there is a plurality of driving ribs at the outer end of each of the narrow slits in the top of said overcap.

3. An overcap according to claim 1 and an inwardly directed lip at the lower end of the skirt of said overcap which extends beneath at least a part of the lower edge of the skirt of the screw cap for retaining said overcap and said screw cap in nested relationship.

4. An overcap according to claim 1 molded from a relatively stiff synthetic resinous material.

* * * * *

UNITED STATES PATENT OFFICE

CERTIFICATE OF CORRECTION

PATENT NO. : 3,951,290

DATED : April 20, 1976

INVENTOR(S) : Gary Van Montgomery

It is certified that error appears in the above-identified patent and that said Letters Patent are hereby corrected as shown below:

Specification, column 2, line 32,

"expensive" should read "inexpensive".

Signed and Sealed this twenty-ninth Day of June 1976

[SEAL]

*Attest:*

RUTH C. MASON
*Attesting Officer*

C. MARSHALL DANN
*Commissioner of Patents and Trademarks*